US008790137B2

(12) United States Patent
Deno et al.

(10) Patent No.: US 8,790,137 B2
(45) Date of Patent: Jul. 29, 2014

(54) FITTING STRUCTURE FOR INNER HOLDER AND SHIELD SHELL

(75) Inventors: Masahiro Deno, Makinohara (JP); Yoshitaka Tsushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 83 days.

(21) Appl. No.: 13/501,143

(22) PCT Filed: Jul. 27, 2010

(86) PCT No.: PCT/JP2010/062987
§ 371 (c)(1),
(2), (4) Date: Apr. 10, 2012

(87) PCT Pub. No.: WO2011/048857
PCT Pub. Date: Apr. 28, 2011

(65) Prior Publication Data

US 2012/0202381 A1 Aug. 9, 2012

(30) Foreign Application Priority Data

Oct. 21, 2009 (JP) ..... 2009-242040

(51) Int. Cl.
*H01R 9/03* (2006.01)

(52) U.S. Cl.
USPC ..... 439/607.41

(58) Field of Classification Search
CPC ..... H01R 13/6593; H01R 13/6581; H01R 13/506; H01R 9/037; H01R 13/6583; H01R 13/6582; H01R 13/65802; H01R 13/516; H01R 13/4223
USPC ..... 439/607.41, 607.52
See application file for complete search history.

(56) References Cited

U.S. PATENT DOCUMENTS 4,986,779 A 1/1991 Ferrill et al.

(Continued)

FOREIGN PATENT DOCUMENTS

| | | | |
|---|---|---|---|
| CN | 101404371 | A | 4/2009 |
| JP | 2007-087698 | A | 4/2007 |
| JP | 2008-300285 | A | 12/2008 |
| JP | 2009-123519 | A | 6/2009 |

OTHER PUBLICATIONS

Office Action mailed Aug. 27, 2013, issued for the corresponding Japanese patent application No. 2009-242040 and English translation thereof.

(Continued)

*Primary Examiner* — Xuong Chung Trans
(74) *Attorney, Agent, or Firm* — Edwards Wildman Palmer LLP

(57) ABSTRACT

An inner holder through which the electric wire connected to the electronic device is passed includes a plurality of peripheral walls. A shield shell adapted to be brought into engagement with the inner holder 3 includes a shield body adapted to be connected to an end of a shield member covering the electric wire and a pair of securing pieces protruding from the shell body toward the inner holder and configured to be overlapped with the peripheral walls. A rib is provided in either of one of the peripheral walls and one of the securing pieces. A notch is provided in the other of the one of the peripheral walls and the one of the securing pieces.

9 Claims, 5 Drawing Sheets

(56) References Cited

U.S. PATENT DOCUMENTS

| | | | | |
|---|---|---|---|---|
| 6,257,929 | B1 | 7/2001 | Wang | |
| 7,297,026 | B2 | 11/2007 | Toda et al. | |
| 7,731,543 | B2 * | 6/2010 | Aoki et al. | 439/697 |
| 8,460,015 | B2 * | 6/2013 | Deno et al. | 439/98 |
| 2007/0066120 | A1 | 3/2007 | Toda et al. | |
| 2009/0093157 | A1 | 4/2009 | Aoki et al. | |
| 2009/0126985 | A1 | 5/2009 | Aoki et al. | |

OTHER PUBLICATIONS

Supplementary European Search Report dated Mar. 5, 2013, issued for the European Patent Application No. 10824709.9.

International Search Report dated Sep. 7, 2010, issued for PCT/JP2010/062987.

Office Action dated Jan. 30, 2014, issued for corresponding Chinese patent application No. 201080047404.6 and English translation thereof.

* cited by examiner

FITTING STRUCTURE FOR INNER HOLDER AND SHIELD SHELL

TECHNICAL FIELD

The present invention relates to a fitting structure for an inner holder and a shield shell, the inner holder being constructed to pass therethrough an electric wire for connection of electronic devices which may be mounted in an automobile, and the shield shell being constructed to electrically shield the electric wire.

BACKGROUND ART

Electric vehicles, hybrid electric vehicles, and fuel-cell vehicles as automobiles incorporate various electronic devices. Also, the electric vehicles, the hybrid electric vehicles, and the fuel-cell vehicles have, as such electronic devices, a motor for generating driving force for running of the vehicle; a battery supplying electrical power to the motor; and an inverter for converting the electrical power of the battery, from direct current power to an alternating current power as supplying the electrical power of the battery to the motor. These electronic devices such as the motor, the battery, and the inverter are connected to each other, and an electrical power with relatively large current value is supplied to electric wires adapted to connect these electronic devices to each other and supply the electrical power and control signals to them. Accordingly, in order to prevent leakage of electrical noise from the electric wires to outside thereof, the electric wires are electrically shielded. Also, in order to electrically shield these electric wires, various types of mounting structures are advocated for mounting a shield shell including a shield member covering the electric wire by shield braid to the inner holder (for example, see the patent literature PTL 1).

FIG. 8 is a perspective view illustrating a state in which the shield shell comes closer to the inner holder in the mounting structure of the conventional inner holder and the shield shell described in the patent literature PTL 1. FIG. 9 is a perspective view illustrating a state where the shield shell shown in FIG. 8 is attached to the inner holder. A mounting structure 101 of the shield shell shown in FIGS. 8, 9 comprises an inner holder 103 constructed to pass an electric wire (not shown) connected to an electronic device therethrough and comprised of a plurality of peripheral walls 105, and a shield shell 104. A locking arm 119 provided on the one peripheral wall 105 out of the peripheral walls 105 is elastically deformable toward the centre of the inner holder 103. The above-described shield shell 104 includes a shell body 108 attached to an end of a shield member (not shown) covering the electric wire, and a pair of securing pieces 137, 138 protruding from the shell body 108 toward the inner holder 103 and being adapted to be placed on the plurality of peripheral walls 105. Also, one securing piece 137 out of the pair of securing pieces 137, 138 includes a retaining hole 137*a* with which the locking arm 119 is locked. The shield shell 104 is attached to the inner holder 103 with the retaining hole 137*a* brought into locking with the locking arm 119.

CITATION LIST

Patent Literature

PTL 1: Japanese patent Application Laid-Open Publication No. 2009-123519

SUMMARY OF INVENTION

Technical Problem

However, in the mounting structure 101 of the above-described conventional shield shell, there are found the following problems. Specifically, in the mounting structure 101 of the conventional shield shell, in a case where the shield shell 104 is to be attached to the inner holder 103, when the other securing piece 138 in which the retaining hole 137*a* is not provided is made closer to the one peripheral wall 105 in which the locking arm 119 is provided, then elastic deformation occurs such that the locking arm 119 is oriented toward the centre of the inner holder 103, so that the other securing piece 138 and the one peripheral wall 105 are overlapped with each other in a state where the locking arm 119 is not brought into locking with the retaining hole 137*a*. In the state where the locking arm 119 is not brought into locking with the retaining hole 137*a*, i.e., where the inner holder 103 and the shield shell 104 are not completely engaged with each other (i.e., in the state of incomplete engagement), the shield shell 104 may be detached from the inner holder 103.

In view of the foregoing problem, an object of the present invention is to provide a fitting structure for the inner holder and the shield shell capable of preventing occurrence of trouble due to the state of incomplete engagement between the inner holder and the shield shell, and capable of bringing the inner holder and the shield shell into (complete) engagement with each other.

Solution to Problem

In order to attain the above objective, the invention according to a first aspect of the present invention, in a fitting structure for an inner holder and a shield shell, the inner holder being adapted to pass therethrough an electric wire connected to an electronic device and including a plurality of peripheral walls, the shield shell including a shell body adapted to be attached to an end of a shield member covering the electric wire and a pair of securing pieces protruding from the shell body toward the inner holder such that the securing pieces are overlapped with the plurality of peripheral walls, the fitting structure comprising: a locking arm provided in either one of one of the peripheral walls and one of the securing pieces; a retaining hole provided in an other of the one of the peripheral walls and the one of is the securing pieces, the locking arm being configured to be brought into locking with the retaining hole so that a state of engagement of the inner holder with the shield shell is maintained, has the features of a rib provided on the either of the one of the peripheral walls and the one of the securing pieces, and a notch provided in the other of the one of the peripheral walls and one of the securing pieces, the notch being configured to pass the rib therethrough.

Another feature according to a second aspect of the present invention is that, in the invention according to the first aspect, the rib comprises a stem and a head provided at an end of the stem, and a front face of the rib is T-shaped.

Yet another feature according to a third aspect of the present invention is that, in the invention according to the first or second aspect, the rib is arranged adjacent to the locking arm.

Still another feature according to a fourth aspect of the present invention, in the invention of either of the first to third aspects, a plurality of the ribs are provided such that the locking arm is positioned the ribs.

Advantageous Effects of the Invention

With the construction and arrangement according to the first aspect of the present invention, the fitting structure includes the inner holder being adapted to pass therethrough the electric wire connected to the electronic device and including the plurality of peripheral walls; the shield shell including the shell body adapted to be attached to the end of the shield member covering the electric wire and the pair of securing pieces protruding from the shell body toward the inner holder such that the securing pieces are overlapped with the plurality of peripheral walls, and further includes the rib provided on the either of the one of the peripheral walls and the one of the securing pieces and the notch provided in the other of the one of the peripheral walls and one of the securing pieces, the notch being configured to pass the rib therethrough. Accordingly, when the peripheral wall or the securing piece having no notch is moved closer to the rib, then the peripheral wall or the securing piece is brought into abutment against the rib. As a result, it is possible to prevent occurrence of a state where the locking arm is not locked with the retaining hole, i.e., a state in which engagement of the inner holder with the shield shell is incomplete (i.e., a state of incomplete engagement is entered). Also, even when an external force acts in the radial direction of the shield shell engaged with the inner holder, by virtue of abutment of the rib with the notch, it is possible to prevent rotation of the shield shell in the radial direction and the resulting detachment of the shield shell from the inner holder.

With the construction and arrangement according to the second aspect of the present invention, the rib includes the stem and the head provided at the end of the stem, and is T-shaped in plan view. Accordingly, it is possible to prevent detachment of the shield shell from the inner holder, by virtue of abutment of the peripheral wall or the securing piece, which includes the notch through the stem, against the head of the rib, even when an external force acts in a direction at right angles to the direction in which the inner holder is engaged with the shield shell.

With the construction and arrangement according to the third aspect of the present invention, since the rib is arranged adjacent to the locking arm, the locking arm is protected against deformation and damage due to an external force acting upon the locking arm as the operator inadvertently let the inner holder fall and hit the floor while assembling of the inner holder and the shield shell.

With the construction and arrangement according to the fourth aspect of the present invention, since the multiple ribs are provided at a position at which the locking arm is disposed therebetween, it is possible to effectively prevent deformation and damage of the locking arm due to the external force acting on the locking arm. Also, by virtue of abutment of the peripheral wall or the securing piece, which has the notch through the stem, against the head of the rib, it is possible to effectively prevent rotation of the shield shell in the radial direction and the resulting detachment of the shield shell from the inner holder even when the external force acts in the radial direction upon the shield shell engaged with the inner holder.

REFERENCE NUMERALS

Figure 1:
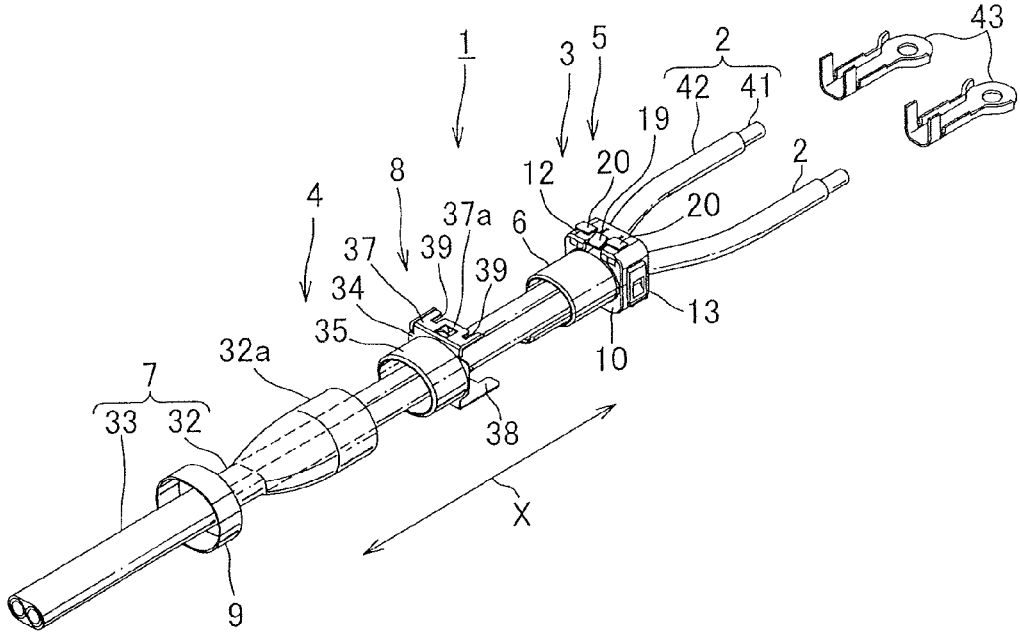
FIG. 1 is an exploded perspective view of a fitting structure for an inner holder and a shield shell according to one embodiment of the present invention.

1 Fitting structure for inner holder and shield shell
2 Electric wire
3 Inner holder
4 Shield shell
7 Shield member
8 Shell body
11 Bottom wall (peripheral wall)
12 Upper wall (one peripheral wall)
19 Locking arm
20 T-shaped rib (rib)
23 Stem
24 Head
37, 38 Pair of securing pieces
37*a* Retaining hole
39 Notch

DESCRIPTION OF THE EMBODIMENT

The following describes a fitting structure for an inner holder and a shield shell according to one embodiment of the present invention with reference to FIGS. 1 to 7.

Figure 2:
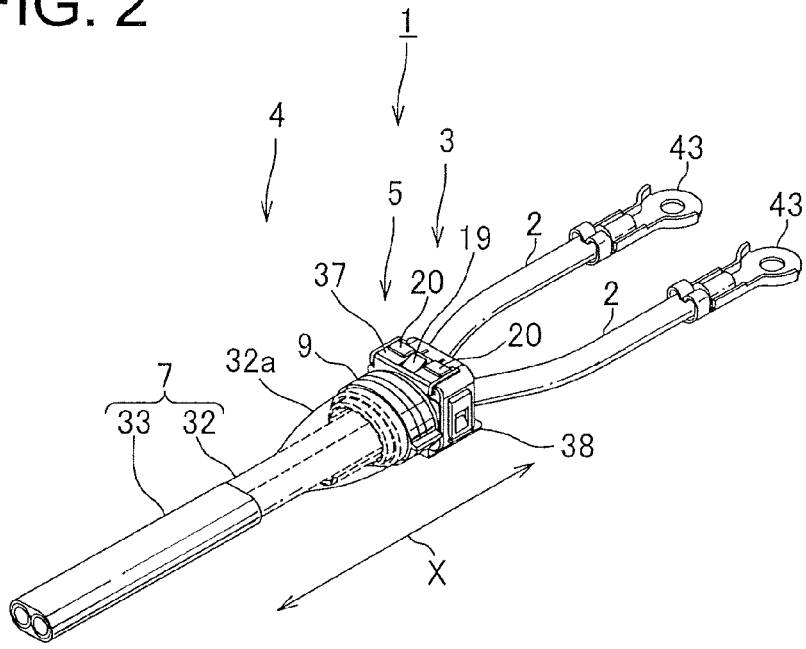
FIG. 2 is a perspective view in which the inner holder and the shield shell shown in FIG. 1 are brought into engagement with each other.

Referring to FIGS. 1, 2, the "fitting structure for the inner holder and the shield shell" of the present invention is a fitting structure 1 constructed to bring an inner holder 3 into engagement with a shield shell 4, with one or more electric wires 2 passed through the inner holder 3, the electric wires 2 being used to connect an inverter and a motor, which are electronic devices mounted in a hybrid vehicle, to each other (two wires are indicated in the illustrated example). Also, the arrow X shown in FIG. 1 represents a direction in which the inner holder 3 is brought into engagement with the shield shell 4 and a direction in which the electric wires 2 extend.

The above-described electric wire 2 is a round electric wire that comprises a core wire 41 made of electrically conductive metal material and a sheath 42 made of electrically insulating synthetic resin. The core wire 41 is constructed by twisted wires made of electrically conductive metal material. LA terminals 43 are each attached to an end of the corresponding electric wires 2, the LA terminal 43 being adapted to connect the electric wire 2 to the electronic devices. Also, the electric wire 2 extends along the arrow X.

Figure 3:
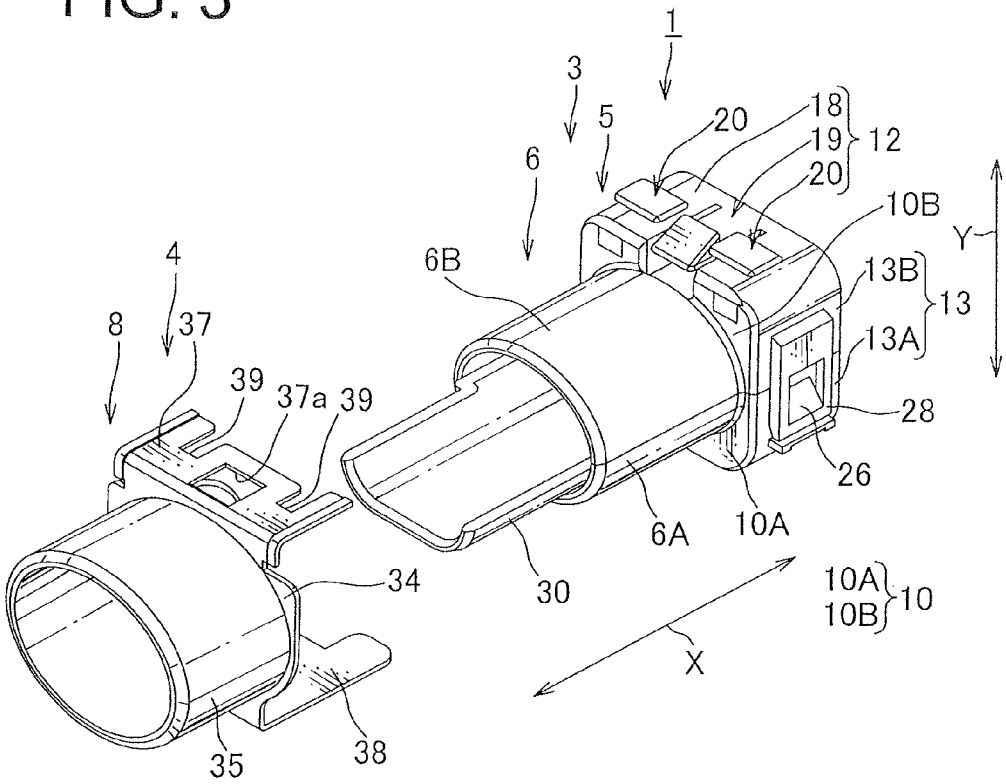
FIG. 3 is an enlarged view of a principal part in which a shell body constituting the shield shell is being attached to the inner holder shown in FIG. 1.
Figure 7:
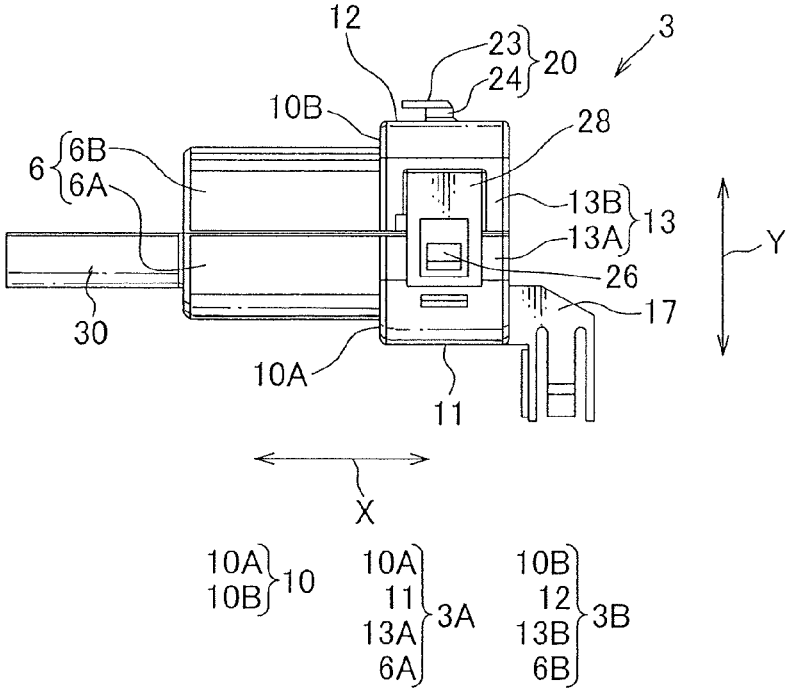
FIG. 7 is a side view of the inner holder shown in FIG. 1.
Figure 8:
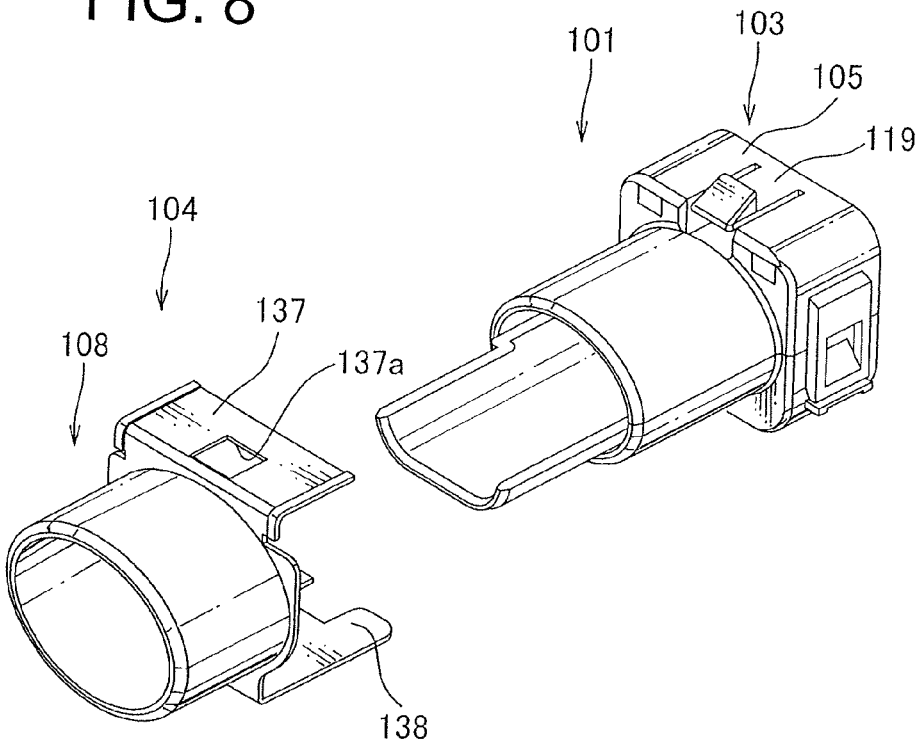
FIG. 8 is a perspective view of a conventional mounting structure of an inner holder and a shield shell, in which the shield shell is made to become closer to the inner holder.
Figure 9:
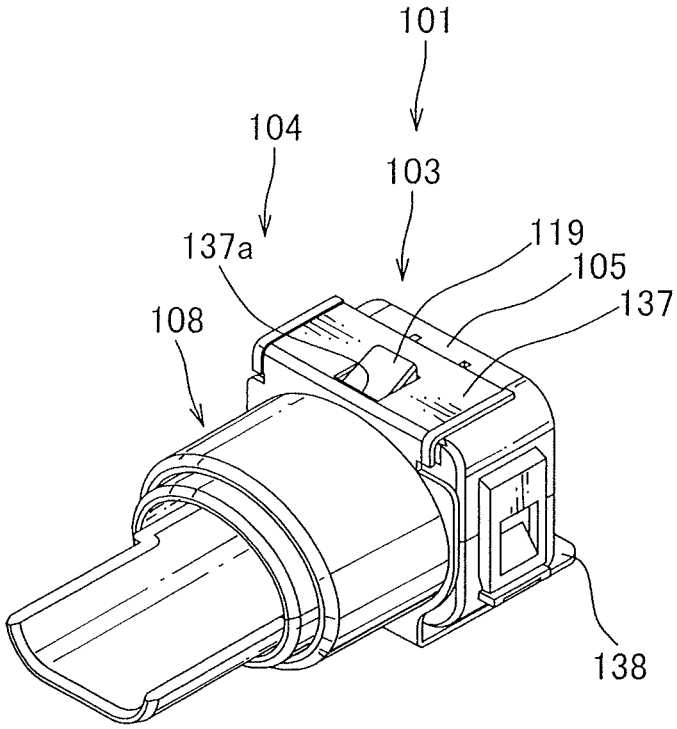
FIG. 9 is a perspective view in which the shield shell shown in FIG. 8 is attached to the inner holder.

The above-described inner holder 3 is, as shown in FIG. 3, made of electrically conductive metal material, and has a shape of a cylinder through which the electric wire 2 connected to the electronic device is passed. Also, the inner holder 3 has a quadrangular external shape, and includes a base portion 5 having a passage hole through which the electric wire 2 is passed, and a cylindrical inner passage portion 6 continuing to an edge of the electric wire passage hole. Also, the inner holder 3 is constructed by, as shown in FIG. 7, disassemblable/reassemblable two components, i.e., a first member 3A and a second member 3B in a direction (indicated by the arrow Y) at right angles to the direction in which the electric wire 2 extends (indicated by the arrow X).

Figure 5:
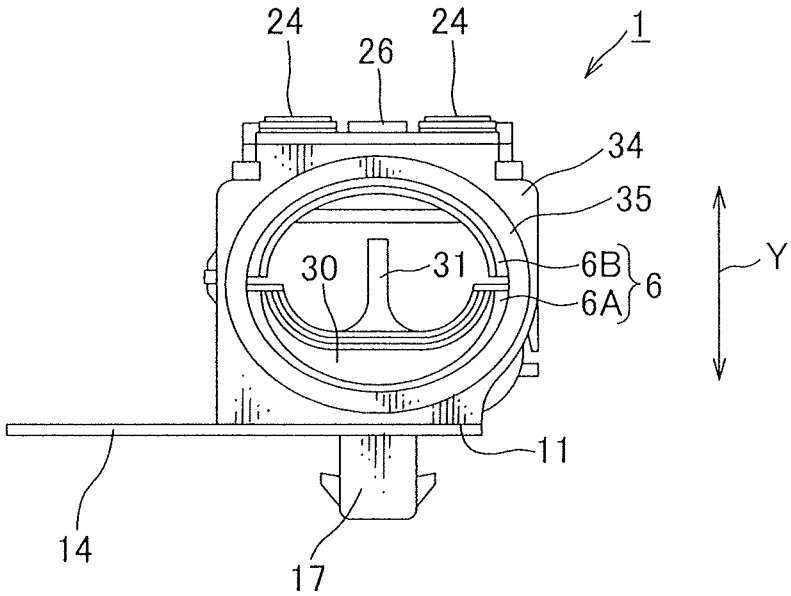
FIG. 5 is a front elevation of the inner holder and the shield shell shown in FIG. 4 that are brought into engagement with each other.

The above-described base portion 5 includes, as shown in FIG. 3, a pair of opposing walls 10 defining the electric wire passage hole; a bottom wall 11 (as shown in FIG. 5) continuing to edges of the pair of opposing walls 10; an upper wall 12 opposed to the bottom wall 11; and a pair of side walls 13 connecting the bottom wall 11 and the upper wall 12 to each other. The side wall 13 includes a first side wall 13A continuing to the bottom wall 11, and a second side wall 13B continuing to the upper wall 12. The opposing wall 10 includes a first opposing wall 10A connecting the pair of first side walls 13A to each other, and a second opposing wall 10B connecting the pair of second side walls 13B to each other. Also, the bottom wall 11 and the upper wall 12 constitute the plurality of the "peripheral walls" in the context of the scope of claims of the present invention. Also, the upper wall 12 constitutes the "one peripheral wall" in the context of the scope of the claims of the present invention.

Referring to FIG. 5, the bottom wall 11 includes an earthing portion 17 protruding along the arrow Y. The earthing portion 17, which is attached to a chassis 14 of the electronic device, secures the inner holder 3 and the shield shell 4, which is locked with (fitted with) the inner holder 3, to the chassis 14. At the same time, later-described noise is grounded via the chassis 14 of the electronic device.

The upper wall 12 includes, as shown in FIG. 3, a body 18, a locking arm 19 provided on an outer surface of the body 18, and a pair of (or a plurality of) T-shaped ribs 20 between which the locking arm 19 is arranged, the ribs 20 being provided adjacent to the locking arm 19.

Figure 4:
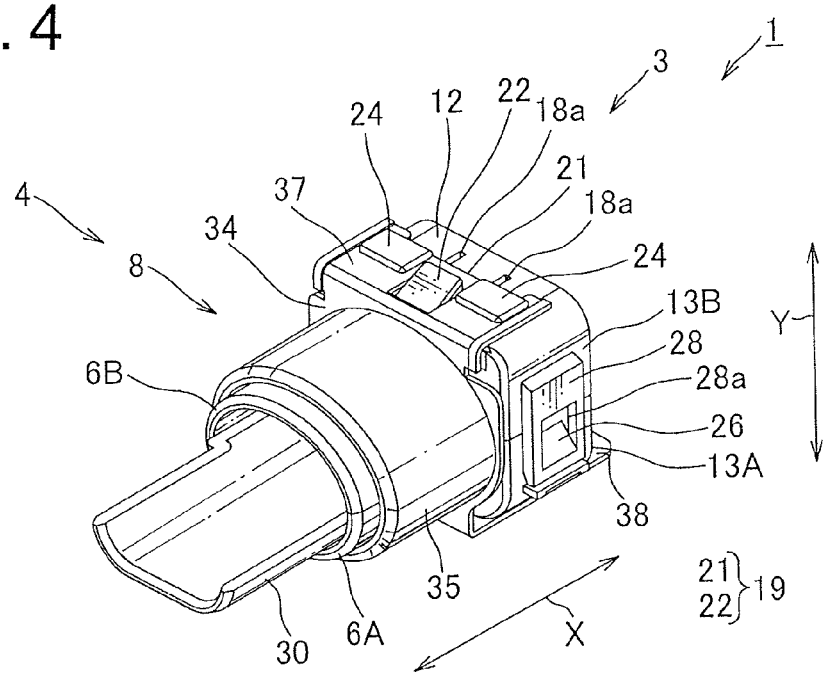
FIG. 4 is a perspective view of the inner holder shown in FIG. 3 with which the shield shell is brought into engagement.

The above-described locking arm 19, as shown in FIG. 4, comprises: an arm body 21 having a slit 18*a* provided between the body 18 and the locking arm 19, with one end thereof continuing to the body 18 and the other end thereof being a free end; and a locking projection 22 provided at the other end of the arm body 21. The locking arm 19 is elastically deformable such that the locking projection 22 is oriented toward the centre of the cylindrically-provided inner holder 3. The locking arm 19 is constructed and arranged such that the locking projection 22 is brought into locking with a later-described retaining hole 37*a*, so that the shield shell 4 is brought into (complete) engagement with the inner holder 3.

The above-described locking projection 22 protrudes from an outer surface of the arm body 21. An amount of protrusion of the locking projection 22 increases gradually from the other end of the arm body 21 toward the aforementioned one end.

Figure 6:
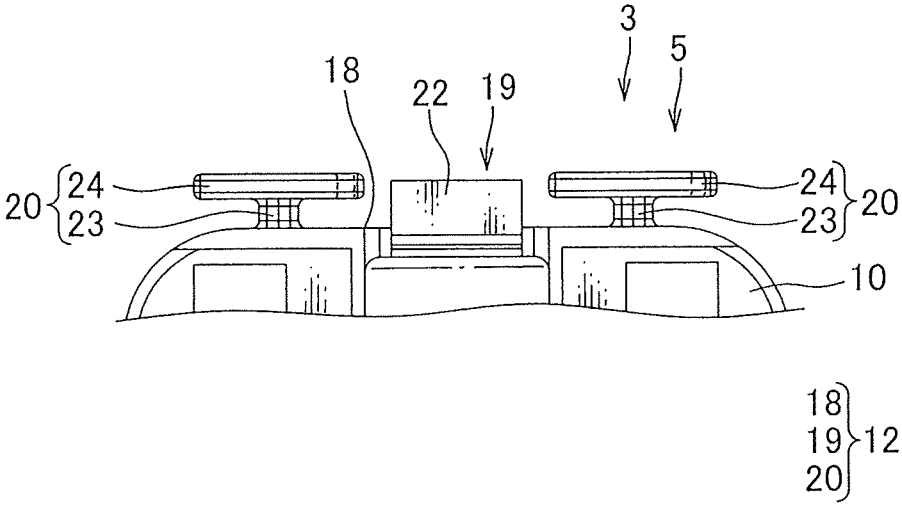
FIG. 6 is an enlarged view of a principal part of the inner holder shown in FIG. 1.

The above-described T-shaped rib 20, as shown in FIG. 6, includes: a stem 23 upstanding from the body 18 and a head 24 continuing to an end of the stem 23 in such a manner that the rib 20 is T-shaped in its plan view. The head 24 is provided in parallel with the body 18. The stem 23 is passed through an inside of the later-described notch 39 of the shield shell 4.

The above-described first side wall 13A has a retaining projection 26 protruding from an outer surface thereof. An amount of protrusion of the retaining projection 26 gradually increases from an edge of the first side wall 13A, the edge being distal with respect to the bottom wall 11, toward the bottom wall 11. Also, the retaining projection 26 is adapted to assemble the inner holder 3 by combining a first member 3A and a second member 3B to constitute the inner holder 3, by virtue of locking achieved by the retaining projection 26 and a locking hole 28*a* provided in a later-described locking piece 28.

The above-described second side wall 13B includes the locking piece 28 having the locking hole 28*a* with which the retaining projection 26 is locked. The locking piece 28 has a plate-like shape, one end of which is attached to an outer surface of the second side wall 13B and the other end thereof being a free end. The locking hole 28*a*, which is adapted to be locked with the retaining projection 26, is provided at this other end. The locking hole 28*a* has a rectangular planar shape.

The above-described inner passage portion 6 includes: a first upstanding portion 6A upstanding in a gutter-like manner at an edge of the first opposing wall 10A along the arrow X; and a second upstanding portion 6B upstanding likewise in a gutter-like manner at an edge of the second opposing wall 10B along the arrow X. Configuration of the upstanding portion 6A and the second upstanding portion 6B is such that an edge in a radial direction of the first upstanding portion 6A and an edge in a radial direction of the second upstanding portion 6B are overlapped with each other to define a cylindrical shape through which the electric wire 2 is passed.

The first upstanding portion 6A includes, as shown in FIG. 5, an inner securing portion 30 adapted to secure the two electric wires 2 that are passed through the inner passage portion 6. The inner securing portion 30 has a shape of gutter which is overlapped with an inner peripheral surface of the first upstanding portion 6A. The inner securing portion 30 is longer in length than the longitudinal direction of the first upstanding portion 6A, and protrudes from the first upstanding portion 6A. Also, the inner securing portion 30 includes a partition wall 31 upstanding from an interior surface of the inner securing portion 30 and extending in the longitudinal direction of the inner securing portion 30. The partition wall 31 is constructed to divide the inner securing portion 30 into two portions and separates the two electric wire 2 passed through the inner passage portion 6.

The first member 3A comprises, as shown in FIG. 7, the bottom wall 11, the first side wall 13A continuing to the bottom wall 11, the first opposing wall 10A continuing to the bottom wall 11, and the first upstanding portion 6A continuing to the first opposing wall 10A. Also, the second member 3B comprises: the upper wall 12, the second side wall 13B continuing to the upper wall 12, the second opposing wall 10B continuing to the upper wall 12, and the second upstanding portion 6B continuing to the second opposing wall 10B.

In the first member 3A and the second member 3B, when the edge of the first side wall 13A is overlapped with then edge of the second side wall 13B, the edge of the first opposing wall 10A is overlapped with the edge of the second opposing wall 10B to constitute the base portion 5, and the edge of the first upstanding portion 6A is overlapped with the edge of the second upstanding portion 6B to constitute the cylindrical inner passage portion 6, and brings the retaining projection 26 of the first side wall 13A into locking with the locking hole 28*a* of the second side wall 13B and thus the inner holder 3 is assembled.

Referring to FIGS. 1 and 2, the above-described shield shell 4 includes: a shield member 7 adapted to cover the electric wire 2; a shield body 8 attached to an end of the shield member 7; and a pair of securing pieces 37, 38 protruding from the shell body 8 toward the inner holder 3 and each adapted to be overlapped with the walls 11, 12 serving as the plurality of the peripheral walls; and a shield ring 9 adapted to attach the shield member 7 to the shell body 8.

The above-described shield member 7 has a shape of a cylinder and includes a shield braid 32 and an external sheath 33 made of electrically insulating synthetic resin and adapted to cover the shield braid 32. The shield braid 32 may be made by twisting wires made of electrically conductive metal material. Also, the shield braid 32 includes a larger diameter portion 32*a* whose inner diameter is enlarged so as to cover a peripheral surface of an outer passage portion 35 of the later-described shell body 8.

The larger diameter portion 32*a* is provided at an end of the shield braid 32. At the larger diameter portion 32*a* including a neighborhood region thereof, an external sheath 33 is partly removed and the shield braid 32 is exposed, the diameter being gradually enlarged toward the end.

The above-described cylindrical shield member 7 is adapted to electrically shield the electric wire 2 by passing thereinside the electric wire 2 and cover the electric wire 2. Also, the term "to shield" means to prevent leakage of electrical noise from the electric wire 2 to an outside of the shield member 7. In this manner, the shield member 7 is adapted to prevent leakage of electrical noise from the electric wire 2 to the outside of the shield braid 32.

As shown in FIG. 3, the above-described shell body 8 includes an overlapping wall 34 constructed to be overlapped with the opposing wall 10, and an outer passage portion 35 to be overlapped with an exterior surface of the inner passage portion 6. The above-described outer passage portion 35 is shorter in length than a longitudinal direction of the inner passage portion 6.

The above-described pair of securing pieces 37, 38 continue to an outer edge of the overlapping wall 34 of the shell body 8. The pair of securing pieces 37, 38 are spaced from each other, and provided at a position at which the base portion 5 of the inner holder 3 is disposed between the securing pieces 37, 38 opposed to each other. Also, out of the pair of securing pieces 37, 38, the securing piece 37 provided on the upper wall 12 includes: the locking hole 28*a* adapted to be brought into locking with the locking arm 19; and a pair of notches 39 provided such that the locking hole 28*a* is provided therebetween. The locking hole 28*a* has a rectangular planar shape. Also, the notch 39 is a notch having an opening at an edge of the securing piece 37 on a proximal side close to the inner holder 3, inside of which the stem 23 of the T-shaped rib 20 is passed through. The notch 39 extends linearly along the arrow X.

The shield ring 9 is ring-shaped. The shield ring 9 is attached to the exterior surface of the larger diameter portion 32*a* of the shield member 7 covering the outer passage portion 35. Also, the shield member 7 is attached to the shell body 8 through plastic defamation in a direction in which the diameter of the shield ring 9 is contracted.

Next, operation is described that brings the inner holder 3 and the shield shell 4 into engagement with each other in the fitting structure 1 of the inner holder 3 and the shield shell 4 with the above-described configuration.

First, the inner holder 3 is assembled, with the electric wire 2, which is connected to the electronic device, placed on the inner securing portion 30 of the first member 3A, with the edges in the radial direction of the first member 3A and the second member 3B brought into contact with each other, and with the retaining projection 26 brought into locking with the locking hole 28*a* of the locking piece 28 provided on the side wall 13. In this manner, the inner holder 3 is assembled.

Next, the exterior surface of the outer passage portion 35 is covered by the larger diameter portion 32*a* of the shield member 7 covering the electric wire 2, so that, after the shield ring 9 is attached to the exterior surface of the outer passage portion 35 covered by the larger diameter portion 32*a*, the shield ring 9 is placed under plastic deformation in a direction in which its diameter decreases so as to attach the shield member 7 to the shell body 8. In this manner, the assembled shield shell 4 is moved closer to the inner holder 3 along the arrow X, and then the stem 23 of the T-shaped rib 20 is passed through the notch 39. Further, the shield shell 4 is further moved closer to the inner holder 3. When, after the locking arm 19 has once elastically deformed inward of the inner holder 3, the locking projection 22 is positioned in the retaining hole 37*a*, then the locking arm 19 is restored in its neutral state by a resilient restoring force. Further, the locking arm 19 of the inner holder 3 is brought into locking with the retaining hole 37*a* of the shield shell 4. Thus, the inner holder 3 and the shield shell 4 are brought into (complete) engagement with each other.

According to the above-described embodiment, there are provided the inner holder 3 and the shield shell 4, the inner holder 3 being configured to pass therethrough the electric wire connected to the electronic device 2, and including the wall 11 and the wall 12 serving as the plurality of peripheral walls, and the shield shell 4 including the shield body 8 attached to the end of the shield member 7 covering the electric wire 2, and the pair of securing pieces 37, 38 protruding from the shell body 8 toward the inner holder 3 and adapted to be overlapped with the wall 11 and the wall 12 serving as the plurality of peripheral wall. Accordingly, the T-shaped rib 20 provided on the upper wall 12 serving as the one peripheral wall and the notch 39 provided in the one securing piece 37 through which the T-shaped rib 20 is passed are provided. Accordingly, when the securing piece 38 having no notch 39 is moved closer to the T-shaped rib 20, then the securing piece 38 is brought into abutment against the T-shaped rib 20. As a result, it is possible to prevent occurrence of a state where the locking arm 37 is not locked with the retaining hole 37*a*, i.e., a state in which engagement of the inner holder 3 with the shield shell 4 is incomplete (i.e., a state of incomplete engagement is entered). Also, even when an external force acts in the radial direction of the shield shell 4 engaged with the inner holder 3, by virtue of abutment of the T-shaped rib 20 with the notch 39, it is possible to prevent rotation of the shield shell 4 in the radial direction and the resulting detachment of the shield shell 4 from the inner holder 3.

In addition, the T-shaped rib 20 comprises the stem 23 and the head 24 provided at the end of the stem 23 such that it becomes T-shaped in plan view. Accordingly, even when an external force acts in the direction (indicated by the arrow Y) at right angles to the direction in which the inner holder 3 is fitted with the shield shell 4, the securing piece 37 having the notch 39, through which the stem 23 has been passed, is brought into abutment against the head 24 of the T-shaped rib 20, so that it is possible to prevent detachment of the shield shell 4 from the inner holder 3 due to application of such an external force.

Also, since the T-shaped rib 20 is provided adjacent to the locking arm 19, it is possible to prevent deformation and damage in the locking arm 19 due to an external force acting upon the locking arm 19 even when an operator let the inner holder 3 fall during assembling operation of the inner holder 3 and the shield shell 4 and the locking arm 19 hits the floor.

Further, since the multiple T-shaped ribs 20 are provided at the position at which the locking arm 19 is disposed therebetween, it is possible to securely prevent deformation and damage in the locking arm 19 due to external force acting upon the locking arm 19. Even when an external force acts in the radial direction of the shield shell 4 with which the inner holder 3 is fitted, the securing piece 37 having the notch 39, through which the stem 23 has been passed, is brought into abutment against the head 24 of the T-shaped rib 20, so that it is possible to effectively prevent detachment of the shield shell 4 from the inner holder 3 due to rotation of the shield shell 4 in the radial direction.

In the above-described embodiment, out of the upper wall 12 serving as the one peripheral wall and the one securing piece 37, the upper wall 12 includes the locking arm 19 and the T-shaped rib 20, and the securing piece 37 includes the retaining hole 37*a* adapted to be locked with the locking arm 19 and the notch 39 through which the T-shaped rib 20 is passed. However, the present invention is not limited to this specific construction and arrangement. For instance, it may also be contemplated that the securing piece 37 includes the locking arm 19 and the T-shaped rib 20, and the upper wall 12 includes the retaining hole 37*a* and the notch 39.

The above-described embodiment is merely a typical one of the present invention, to which the present invention is in no way limited. Accordingly, the present invention may be effectuated with various modifications without departing from the scope of the present invention.

The invention claimed is:

1. A fitting structure for an inner holder and a shield shell,
the inner holder
being adapted to pass therethrough an electric wire connected to an electronic device and
including a plurality of peripheral walls,
the shield shell including
a shell body adapted to be attached to an end of a shield member covering the electric wire and
a pair of securing pieces protruding from the shell body toward the inner holder such that both of the securing pieces are overlapped with a pair of the plurality of peripheral walls,
the fitting structure comprising:
a locking arm provided on either one of the pair of the peripheral walls and one of the securing pieces;
a retaining hole provided on either the other of the pair of the peripheral walls and the other of the securing pieces, the locking arm being configured to be brought into locking with the retaining hole so that a state of engagement of the inner holder with the shield shell is maintained;
a rib provided on either the one of the pair of the peripheral walls and the one of the securing pieces; and
a notch provided on either the other of the pair of the peripheral walls and the other of the securing pieces, the notch being configured to pass the rib therethrough.

2. The fitting structure for the inner holder and the shield shell according to claim 1, wherein the rib comprises a stem and a head provided at an end of the stem, and a front face of the rib is T-shaped.

3. The fitting structure for the inner holder and the shield shell according to claim 1, wherein the rib is arranged adjacent to the locking arm.

4. The fitting structure for the inner holder and the shield shell according to claim 1, wherein a plurality of the ribs are provided such that the locking arm is positioned the ribs.

5. The fitting structure for the inner holder and the shield shell according to claim 2, wherein the rib is arranged adjacent to the locking arm.

6. The fitting structure for the inner holder and the shield shell according to claim 2, wherein a plurality of the ribs are provided such that the locking arm is positioned the ribs.

7. The fitting structure for the inner holder and the shield shell according to claim 3, wherein a plurality of the ribs are provided such that the locking arm is positioned the ribs.

8. The fitting structure for the inner holder and the shield shell according to claim 5, wherein a plurality of the ribs are provided such that the locking arm is positioned the ribs.

9. The fitting structure for the inner holder and the shield shell according to claim 1, wherein
the locking arm is provided only on one of the pair of the peripheral walls;
the rib is provided on the one of the pair of the peripheral walls; and
the notch is provided only on one of the securing pieces.

* * * * *